US005391535A

United States Patent [19]

Ito et al.

[11] Patent Number: 5,391,535

[45] Date of Patent: Feb. 21, 1995

[54] INK RIBBON AND IMAGE FORMING METHOD USING THE SAME

[75] Inventors: Kengo Ito; Hideki Hirano, both of Kanagawa, Japan

[73] Assignee: Sony Corporation, Tokyo, Japan

[21] Appl. No.: 950,654

[22] Filed: Sep. 23, 1992

[30] Foreign Application Priority Data

Sep. 26, 1991 [JP] Japan ..... 3-247932

[51] Int. Cl.[6] ..... B41M 5/035; B41M 5/38

[52] U.S. Cl. ..... 503/227; 428/195; 428/913; 428/914; 430/200; 430/348

[58] Field of Search ..... 8/471; 428/195, 913, 428/914; 503/227; 430/200, 348

[56] References Cited

U.S. PATENT DOCUMENTS 5,045,524 9/1991 Chapman et al. ..... 503/227

FOREIGN PATENT DOCUMENTS 0498267 8/1992 European Pat. Off. ..... 503/227
0506034 9/1992 European Pat. Off. ..... 503/227

OTHER PUBLICATIONS

Patent Abstracts of Japan, vol. 10 No. 342 (M-536) (2398) dated Nov. 19, 1986, "Thermal Transfer Type Recording Medium", JP-A-61-143184.

Patent Abstracts of Japan, vol. 13 No. 274 (M-841) (3622), Jun. 23, 1989, "Image-Receiving Sheet For Sublimation Transfer Type Thermal Recording", JP-A-10 72898.

Patent Abstracts of Japan, vol. 10, No. 357 (M-540) (2414), Dec. 2, 1986, "Thermal Transfer Recording Medium", JP-A-61 154995.

Japanese Application No. 61-154995, pp. 581-587.

*Primary Examiner*—B. Hamilton Hess

*Attorney, Agent, or Firm*—Hill, Steadman & Simpson

[57] ABSTRACT

Disclosed are an ink ribbon containing an amphiphilic acid dye or basic dye, which has an excellent thermal transfer sensitivity and which may form an image with high fixation comparable to that of silver salt photographic images, and an image forming method using the ink ribbon. The method comprises bringing the ink ribbon containing an amphiphilic acid dye or basic dye into contact with a photographic paper containing a precipitating agent capable of laking by salt formation with an acid dye or basic dye so that the acid dye or basic dye is transferred and fixed from the ink ribbon to the photographic paper by thermal stimulation.

11 Claims, 1 Drawing Sheet

INK RIBBON

INK RIBBON

INK RIBBON AND IMAGE FORMING METHOD USING THE SAME

FIELD OF THE INVENTION

The present invention relates to an ink ribbon suitable to use, for example, in color video printers of thermal transfer system and also relates to an image forming method using it.

BACKGROUND OF THE INVENTION

An image forming method by thermal transfer system has been attempted, for example, for printing out an image as taken with an electronic still camera or the like, to a photographic paper like silver salt photography.

In accordance with the thermal transfer system of the type, an ink ribbon containing dyes is brought into contact with a photographic paper having an image-receiving layer as formed thereon and the ink ribbon is heated with a thermal head or the like so that the dyes in the ink ribbon are transferred to the image-receiving layer of the paper. As the image-receiving layer of a photographic paper, used is a polyester; and as the dyes to be in an ink ribbon, used are disperse dyes.

Various reformations and modifications have heretofore been applied to disperse dyes which are generally used in the system of the kind, for example, those disclosed in JP-A 1-259989 and 1-275096 (the term "JP-A" as used herein means an "unexamined published Japanese patent application"). However, after transferred to an image-receiving layer, they are retained therein by mere interaction between the transferred dyes and the layer, for example, by van der Waals force of the former to the high polymer substance of the latter, interamphoteric force or hydrogen bond therebetween or the like. Therefore, where the layer to which dyes have been transferred is brought into contact with a resin or solvent having a higher affinity to the dyes or where heat energy enough to dismiss the interaction is imparted to the layer, migration of dissolution of the transferred dyes would thereby be induced or the image formed would become blurred, disadvantageously.

Under the situation, other means based on formation of chemical bond between transferred dyes and an image-receiving layer have been proposed, for example, in JP-A 59-78893, 60-2398, 60-110494, 60-220785, 60-260381 and 60-260391.

The methods disclosed in the laid-open specifications are a method of incorporating a compound having epoxy groups or isocyanate groups into an image-receiving layer to which dyes having groups capable of reacting with the epoxy or isocyanate groups are applied; a method of incorporating a compound having active hydrogens to an image-receiving layer to which dyes having acryloyl groups or methacryloyl groups are applied; a method of incorporating a metal compound into an image-receiving layer to which dyes capable of forming metal complexes with the metal compound are applied; and a method of subliming and transferring a low molecular compound having an active methyl group (or methylene group) to an image-receiving layer followed by reacting the compound with an aldehyde (nitroso) compound to form a dye in the layer.

However, the means based on formation of chemical bond have various drawbacks that the reactivity of the dyes and the image-receiving layer is too high so that the storage stability of them is poor, that the reaction is not finished in a short period of time and therefore a long time is needed for forming a stable image, and that preparation of the dyes is difficult and the kind of usable dyes is limited. In addition, even by the means, fixation of the transferred dyes could hardly be said to be sufficient.

As mentioned above, the conventional thermal transfer system has a serious problem of migration of the transferred dyes due to insufficiency of the fixability of them on the image-receiving layer, which is a bar to practical operation of the system. Therefore, improvement of the point is desired.

SUMMARY OF THE INVENTION

Under the situation, the present invention has been proposed for the purpose of overcoming the problems in the prior art, and one object thereof is to provide an ink ribbon having an excellent thermal transferring sensitivity and having a fixability of the transferred dyes therefrom to be able to form an image comparable to silver salt photographic images. Another object of the present invention is to provide an image forming method using the ink ribbon.

An image forming material for fixation type thermal transfer system as disclosed in Japanese Patent Application No. 3-89592 has a fixation effect in a complete hydrophobic system (or a medium system with a low dielectric constant) by salt formation. As opposed to this, the same fixation effect by salt formation has been attained by the present invention even in a hydrophilic system (or a system with a high dielectric constant), which is still another object of the present invention.

Specifically, there is provided in accordance with the present invention an ink ribbon having an ink layer 1, which contains an amphiphilic acid dye or basic dye to be prepared by substituting the inorganic ions of an acid dye or basic dye by organic ions having a suitable hydrophilicity, as formed on a support 2. There is also provided in accordance with the present invention an image forming method using the ink ribbon, in which the ink ribbon containing an amphiphilic acid dye or basic dye is brought into contact with a photographic paper containing a precipitating agent capable of laking due to salt formation with the acid dye or basic dye whereby the acid dye or basic dye is transferred and fixed onto the photographic paper from the ink ribbon by thermal stimulation.

In accordance with the present invention, an ink ribbon containing an amphiphitic acid dye or basic dye is brought into contact with a photographic paper containing a precipitating agent capable of laking due to salt formation with the acid dye or basic dye, whereby the acid dye or basic dye is transferred and fixed onto the photographic paper from the ink ribbon by thermal stimulation. Accordingly, the fixation of the transferred dye on the photographic paper may noticeably be improved to be able to yield on the paper an image having a fixability comparable to that of silver salt photographic images.

DETAILED DESCRIPTION OF THE INVENTION

Figure 1:
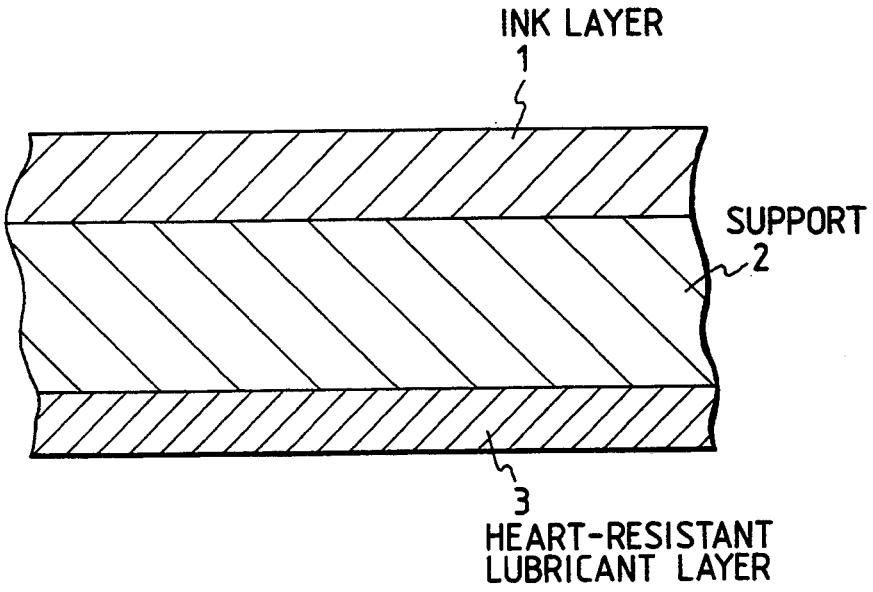
FIG. 1 shows a line work view of showing one embodiment of an ink ribbon of the present invention, in which 1 is an ink layer, 2 is a support and 3 is a heat-resistant lubricant layer.

One embodiment of the ink ribbon of the present invention as well as that of an image forming method of using it will be explained hereunder.

A method of preparing the ink ribbon of the present invention will be explained with reference to FIG. 1.

Preparation of Dyes:

Preparation of Acid Dye:

1000 cc of an aqueous solution of 10 g of sodium copper phthalocyanine-tetrasulfonate (produced by Kodak) was prepared. The solution was dropwise added to 2000 cc of a water/ethanol (1/1, by volume) solution containing 19.57 g of tetra-n-hexylammonium bromide as dissolved therein. A part of the mixture was taken out, to which the same amount of chloroform was added and shaken. After it was statically left as it was, the dye was partitioned also into the oily phase with a partition ratio of about 0.3/1 (oil/water). In the same extraction experiment, the starting material was not almost partitioned into the oily phase. Thus, it is obvious that the dye was made amphiphilic by the treatment. Next, much water was added to the mixture, whereupon a dark blue precipitate formed. The precipitate was taken out by filtration, washed with hexane and dried at room temperature under reduced pressure to give about 30 g of a solid. Although the starting dye was insoluble in ethanol, the solid (dye) obtained by the treatment was soluble in a mixed solvent of water/ethanol. For purification, about 30 g of the dye formed was dissolved in 200 g of a mixed solvent of water/ethanol, 2 g of acidic terra alba was added thereto and ultrasonically stirred for 5 minutes, then the precipitate formed was taken out by filtration. The filtrate was dried with an evaporator under reduced pressure to give a dye of almost the same amount of the starting material.

Preparation of Basic Dyes:

Three primary color dyes (for subtractive mixture) of yellow (Y), magenta (M) and cyan (C) were amphiphilicated in the manner mentioned below.

As the mother dyes, used were Auramine O (Y), Rhodamine B (M) and Methylene Blue (C), all as their hydrochlorides.

First, 600 cc of an aqueous solution containing 2 g of Auramine O (Y) as dissolved therein was prepared. 50 g of ethanol solution containing 1 g of sodium paratoluenesulfonate was dropwise added thereto to form a precipitate. The precipitate was taken out by filtration, washed with hexane and dried at room temperature under reduced pressure to obtain about 2 g of a solid. Although the starting dye was insoluble in MEK (methyl ethyl ketone), the solid (dye) obtained by the treatment was soluble in a mixed solvent of water/-MEK. Thus, the dye obtained by the treatment was obviously amphiphilic.

The same treatment was applied also to Rhodamine B (M) and to Methylene Blue (C) to amphiphilicate them.

Formation of Ink Ribbons:

Formation of Ink Ribbon Containing Acid Dye:

Using the acid dye prepared above, an ink ribbon was formed.

Precisely, the phthalocyanine dyes obtained above was dissolved in MEK together with a polyester resin as a binder polymer to form a coating solution.

| Composition | parts by weight |
|---|---|
| Polyester | 1 |
| Dye | 1 |
| MEK | 20 |

The solution was coated over a PET film having a heat-resistant lubricant backing layer on the back surface thereof, with a wire bar and dried with a hot air of 120° C. for 2 minutes to obtain a ribbon having a transparent color layer with a dry thickness of about 1 μ.

Formation of Ink Ribbon Containing Basic Dye:

Each of the basic dyes as obtained in the above was dissolved in a mixed solvent of MEK/ethanol containing polyvinyl butyral (BL-1, trade name by Sekisui Chemical Co.) to obtain a coating solution having the following composition. Three kinds of coating solutions were thus obtained.

| Composition | parts by weight |
|---|---|
| Polyvinyl Butyral | 1 |
| Dye | 1 |
| MEK/ethanol (1/1 by weight) | 50 |

The solution was coated over a PET film having a heat-resistant lubricant backing layer on the back surface thereof, with a wire bar and dried with a hot air of 120° C. for 2 minutes to obtain a ribbon having a transparent color layer with a dry thickness of about 1 μ.

Next, one embodiment of an image forming method using these ink ribbons is mentioned below.

Confirmation of Dye Fixed Effect on Photographic Paper:

Ribbon with Acid Dye:

Preparation of Photographic Paper:

An aqueous solution containing barium chloride and a modified vinyl acetate in a weight ratio mentioned below was prepared and was coated over a neutral paper having a thickness of about 200 μ with to form an image-receiving layer having a wet thickness of 100 μ, which was then dried at 120° C. for one hour under reduced pressure. Next, the photographic paper having the white image-receiving layer was passed through pressure rollers heated at 100° C. to make it glossy.

| Composition of Coating Solution | parts by weight |
|---|---|
| Barium Chloride | 1 |
| Modified Vinyl Acetate | 5 |
| Silicone Oil | 5 |
| Water/methanol (1/9 by volume) | 50 |

Printing Experiment:

Using the ink ribbon and the photographic paper thus formed, formation of an image on the paper was effected in a practical manner. Precisely, the ribbon was set in a ribbon cassette of a Sony's color video printer CVP-G500 Model, and the photographic paper in a photographic paper cassette thereof. Using the printer, gradation printing was effected to yield a cyan tone glossy image rich in gradation. Next, water was sprayed over the image and the paper with the image was passed through a hot-pressure (100° C.) rollers at a feeding rate of 5 mm/sec.

The migration resistance of the image formed was evaluated in the manner mentioned below. A film having a dry thickness of 100 μ was formed from a coating solution having the composition mentioned below with a wire bar. This was used as a film to which the dye of the image will migrate. This was adhesive at room temperature and may easily adhere to and peel off from an image-receiving layer of a photographic paper.

| Composition of Coating Solution | parts by weight |
|---|---|
| Butyral Resin | 1 |
| Ethanol (solvent) | 50 |

The adhesive film was attached to the image formed on the photographic paper and left as it was for 30 seconds at 100° C. Then, this was peeled off from the paper. The same migration resistance test was effected, using a conventional photographic paper containing no precipitating agent (in which the other components and compositions were same as those in Example 1). As a result, the image formed in accordance with the present invention retained almost 100% image density, while the image formed on the conventional photographic paper retained only about 10% image density (or that is, 90% of the image density migrated to the adhesive film). From the result, the fixation effect of the present invention is obvious.

Ribbon with Basic Dye:

Preparation of Photographic Paper:

One g of acidic terra alba (Japanese Acid Clay, produced by Wako Pure Chemicals Co.) was swollen and dispersed in 100 cc of water, and 20 g of an aqueous solution of 5 wt. % polyvinyl alcohol (polymerization degree 500, produced by Wako Pure Chemicals Co.) was added to the dispersion. This was ultrasonically dispersed for one hour to obtain a white slurry. The slurry was coated over a coated paper (having thickness of about 200 μm) with a wire bar and dried with a hot air and then at 120° C. for one hour under reduced pressure to obtain a photographic paper having an image-receiving layer with a dry thickness of 5 μm. When the photographic paper was dipped in water, the coated film swelled but did not dissolve therein.

Printing Experiment:

Using the ink ribbon and the photographic paper thus formed, formation of an image on the paper was effected in a practical manner. Precisely, the ribbon was set in a ribbon cassette of a Sony's color video printer CVP-G500 Model, and the photographic paper in a photographic paper cassette thereof in the order of Y, M, C. Using the printer, solid coloration (complete plane coloration) printing was effected to yield a blackish brown tone glossy image.

Next, an absorbent cotton containing water was rubbed over the image formed so that the image-receiving layer was swollen. After thus rubbing, the image did not flow.

A part of the image was put in ethanol (the same solvent as that used in preparing the image-receiving layer) at room temperature, whereupon no apparent change of the image was noted. The reflection density of the image before and after dipping thereof in the solvent was measured to the result that the image including the part as kept in contact with the solvent vapor was not blurred at all though the O.D. value thereof somewhat decreased from 2.2 to 2.1 after dipping. The same fixation test was effected by dipping the image in water, whereupon no dye dissolved out. From the results, complete fixation of the image was clarified.

Table 1 below shows the uppermost limit, lowermost limit and preferred range of each of the dye concentration in an ink and the precipitating agent concentration in an image-receiving layer, when an acid dye or a basic dye is used.

The uppermost limit of the dye concentration in an ink of being 100% by weight is for the case of using a dye having a film-forming property. Where a dye not having a film-forming property is used, a binder resin is needed. If the dye concentration in an ink is lower than 5% by weight, sufficient coloration could not be attained.

Where the precipitating agent concentration in an image-receiving layer is more than 90% by weight, film-forming would be impossible since the precipitating agent itself has no film-forming property. If, on the contrary, it is less than 5% by weight, sufficient fixation of dyes onto a photographic paper could not be attained.

TABLE 1

| | Range of Concentration of Dye and Precipitating Agent | | |
|---|---|---|---|
| | Uppermost limit | Lowermost limit | Preferred range |
| Dye concentration in ink (wt. %) | 100 | 5(*1) | 80 to 20 |
| Precipitating agent concentration in image-receiving layer (wt. %) | 90 | 5(*2) | 80 to 10 |

(*1) This is for obtaining practical density and sensitivity.
(*2) This is for attaining practical fixation.

The image-receiving layer may contain any other auxiliary compounds (e.g., brightening agent, plasticizer, moisture absorbing agent, etc.), provided that they do not interfere with the interionic salt formation reaction in the layer. The binder resin to be in the layer may not always be a water-swelling one but may be one capable of giving a dielectric constant sufficient for inducing salt formation reaction by itself or may also be a mixture with the corresponding low molecular compound.

In the case, water dipping operation is unnecessary.

Next, in order to confirm the behavior of dyes in an image-receiving layer of a photographic paper, simulation of fixation and movement of dyes in the layer was effected.

Acid Dye:

As an acid dye used was sodium copper phthalocyanine tetrasulfonate (produced by Kodak).

One part by weight of the dye was dissolved in 1000 parts by weight of ethanol, and 10 parts by weight of an aqueous 1 wt. % barium chloride solution was dropwise added thereto to immediately give a dark blue precipitate and an almost colorless supernatant. The precipitate was recovered by filtration, washed with a large amount of water and then washed with acetone, ethyl acetate and toluene in order, whereupon no dye dissolved out. Accordingly, the dye was confirmed to be pigmented.

From the results, it is clarified that a dye as amphiphilicated with a solvent having a high dielectric constant such as ethanol is pigmented by salt formation. This means that when a dye is substituted by organic cations having a lower ion-bonding force than the cations of a laking agent (precipitating agent) and the thus substituted dye is used in forming an ink ribbon, then the dye may easily be ion-exchanged in a high dielectric constant medium of high ion-dissociation ability.

In the same manner as above, other anionic dyes may be amphiphilicated. Organic cations for the purpose may be selected from commercial surfactants, ammonium salts and phosphonium salts, and they are preferably such that the partition coefficient of the dye salts to be formed therewith in a water/chloroform system is from 0.05 to 10.

As organic cationic surfactants for the purpose, there are mentioned, in addition to tetra-n-hexylammonium bromide, tetra-n-butylammonium borofluoride, tetra-n-butylammonium perchlorate, cetyltrimethylammonium bromide, dioctadecyldimethylammonium chloride, myrityldimethylbenzylammonium chloride, benzyldimethyl-[2-[2-(p-1,1,3,3-tetramethylbutylphenoxy)ethoxy]ethyl]ammonium chloride, alkylpyridinium salts and imidazolinium salts.

For laking general acid dyes, typical combinations of dye and precipitating agent are shown in Table 2 below.

TABLE 2

| Examples of Combination of Acid Dye and Precipitating Agent | |
|---|---|
| Acid Dye | Precipitating Agent (Laking Agent) |
| Nitro Compounds | |
| Naphthol Yellow S | Barium chloride<br>Aluminium chloride (*1) |
| Azo Compounds | |
| Naphthol type | |
| Lake Scarlet 2R | |
| Orange 2 | |
| Lake Red C, D | |
| Brilliant Carmine 6B | (Alkaline earth metal salts, manganese salts)(*2) |
| Watching Red | |
| Pyrazolone type | |
| Tartrazine O | |
| Fastlight Yellow 3 | |
| Aminonaphthol type | |
| Anthocyan B | |
| Anthocyan 3B | |
| Triphenylmethane type | |
| Erygrosine A | |
| Acid Green B | |
| Alkali Blue | (Sodium salts)(*2) |
| Metal Chelate Dyes | |
| Nitroso-β-naphthol Iron Salt | |

(*1) It is usable as a precipitating agent for all the following acid dyes.
(*2) These are usable for only the acid dyes in the corresponding left column.

Basic Dyes:

Fixation Test:

0.2 g of acidic terra alba was put in 20 g of ethanol and dispersed therein by irradiation of ultrasonic waves thereto for several minutes. One cc of ethanol solution of 10 mmol of Rhodamine 6G was added to the dispersion to immediately give a dark orangish red precipitate and an almost colorless (but somewhat yellowish orange fluorescent) supernatant. The color precipitate was recovered by filtration, washed with 100 cc of ethanol to completely remove the non-reacted dye therefrom, and then dried- at room temperature. The interlayer distance of the orangish red powder thus recovered by the operation was measured to be 16.03 Å, which was larger than that (9.77 Å) of the non-treated acidic terra alba by about 6 Å.

When the powder was dipped in water or in other organic solvents (alcohol, MEK, toluene, etc.), dissolution of the dye thereinto did not occur. From the fact, the dye was confirmed to be pigmented.

In the same manner, other basic dyes may be amphiphilicated. Organic anions for the purpose may be selected from commercial organic anionic surfactants, and they are preferably such that the partition coefficient of the dye salts to be formed therewith in a water/chloroform (1/1, by weight) system is from 0.05 to 10.

As organic anionic surfactants for the purpose, there are mentioned, in addition to sodium paratoluenesulfonate, soaps, carboxylic acid salts such as N-acylamino acid salts, alkyl ether carboxylic acid salts, acylated peptides; as well as sulfonic acid salts such as alkylsulfonic acid salts, alkylbenzenesulfonic acid salts, alkylnaphthalenesulfonic acid salts, sulfosuccinic acid salts, α-olefinsulfonic acid salts and N-acylsulfonic acid salts; sulfate ester salts such as sulfated oils, alkylsulfate salts, alkyl ether sulfate salts, alkylaryl ether sulfate salts and alkylamide sulfate salts; and phosphate ester salts such as alkylphosphate salts, alkyl ether phosphate salts and alkylaryl ether phosphate salts.

For laking general basic dyes, typical combinations of dye and precipitating agent are shown in Table 3 below.

TABLE 3

| Examples of Combination of Basic Dye and Precipitating Agent | |
|---|---|
| Basic Dye | Precipitating Agent (Laking Agent)(*1) |
| Auramine O | Phosphorus Tungsten molybdate |
| Malakite Green | Phosphorus wolframate |
| Brilliant Green | Phosphorus molybdate |
| Methyl Violet B | Tannic acid |
| Victoria Pure Blue | Tartaric acid |
| Rhodamine B | Terra alba |
| Astraphloxin FF | Chlorate |
| Thioflavin T | Higher fatty acids |
| Methylene Blue | |

(*1) All the precipitating agents in the right column are usable as a precipitating agent to each of the basic dyes in the left column.

In accordance with the present invention as supported by the above-mentioned example, the fixability of the dye may noticeably be improved and an image having a high fixation comparable to that of silver salt photographic images can be formed.

In addition, not only the fixability but also other necessary characteristics such as light-fastness, color tone and sensitivity are also improved by the present invention.

Further, since the method of forming the ink ribbon of the present invention follows the techniques of the related conventional methods, any and every apparatus for the conventional methods may directly be applied to the method of the present invention.

Needless to say, the present invention is not whatsoever limited by the above-mentioned embodiments but may have any other various constitutions without overstepping the spirit of the invention.

In accordance with the present invention as explained in the above, the fixation of dyes in the formed image may noticeably be improved to be comparable to that in silver salt photographic images. In addition, not only the fixability but also other necessary characteristics such as light fastness color tone and sensitivity may also be improved by the present invention. Since the method of forming the ink ribbon of the present invention follows the techniques of the related conventional methods, as mentioned above, the present invention has still another merit that any and every apparatus for the conventional methods may directly be applied thereto with no specific modification.

While the invention has been described in detail and with reference to specific embodiments thereof, it will be apparent to one skilled in the art that various changes and modifications can be made therein without departing from the spirit and scope thereof.

What is claimed is:

1. A method of forming an image, in which an ink ribbon containing an amphiphilic acid dye or basic dye is brought into contact with a photographic paper containing a precipitating agent capable of laking by salt formation with an acid dye or basic dye, and the acid dye or basic dye is transferred and fixed from the ink ribbon to the photographic paper by thermal stimulation to form an image on the paper.

2. The method as claimed in claim 1, in which the amphiphilic acid dye or basic dye has a partition coefficient in a water/chloroform system (1/1, by weight) of being from 0.05 to 10.

3. The method as claimed in claim 1, in which the dye concentration in the ink is from 5 to 100% by weight.

4. The method as claimed in claim 1, in which the concentration of the precipitating agent in the image-receiving layer is from 5 to 90% by weight.

5. The method as claimed in claim 1, in which the organic cation for amphiphilicating the anionic dye is at least one selected from tetra-n-hexylammonium bromide, tetra-n-butylammonium borofluoride, tetra-n-butylammonium perchlorate, cetyltrimethylammonium bromide, dioctadecyldimethylammonium chloride, myrityldimethytbenzylammonium chloride, benzyldimethyl-ammonium chloride, alkylpyridinium salts and imidazolinium salts.

6. The method as claimed in claim 1, in which the organic anion for amphiphilicating the basic dye is at least one selected from sodium paratoluenesulfonate, soaps, carboxylic acid salts, sulfonic acid salts, sulfate ester salts, and phosphate ester salts.

7. The method as claimed in claim 6, wherein the carboxylic acid salts are N-acylamino acid salts, alkyl ether carboxylic acid salts and acylated peptides.

8. The method as claimed in claim 6, wherein the sulfonic acid salts are alkylsulfonic acid salts, alkylbenzenesulfonic acid salts, alkylnaphthalene sulfonic acid salts, sulfosuccinic acid salts, $\alpha$-olefinsulfonic acid salts and N-acylsulfonic acid salts.

9. The method as claimed in claim 6, wherein the sulfate ester salts are sulfated oils, alkylsulfate salts, alkyl ether sulfate salts, alkylaryl ether sulfate salts and alkylamide sulfate salts.

10. The method as claimed in claim 6, wherein the phosphate ester salts are alkylphosphate salts, alkyl ether phosphate salts and alkylaryl ether phosphate salts.

11. The method as claimed in claim 1, in which the ink ribbon having an ink layer as formed on a support, the ink layer contains an amphiphilic acid dye or an amphiphilic basic dye prepared by substituting inorganic ions of an acid dye or basic dye by organic ions having suitable hydrophilicity.

* * * * *